US007075249B2

(12) United States Patent
Hartikka et al.

(10) Patent No.: US 7,075,249 B2
(45) Date of Patent: Jul. 11, 2006

(54) ARRANGEMENT IN CONNECTION WITH A COUPLING DEVICE OF A FLUORESCENT LAMP

(75) Inventors: Yrjö Hartikka, Pennala (FI); Jouko Kuisma, Lahti (FI)

(73) Assignee: Teknoware OY, Lahti (FI)

( * ) Notice: Subject to any disclaimer, the term of this patent is extended or adjusted under 35 U.S.C. 154(b) by 0 days.

(21) Appl. No.: 11/016,607

(22) Filed: Dec. 17, 2004

(65) Prior Publication Data

US 2005/0140301 A1 Jun. 30, 2005

(30) Foreign Application Priority Data

Dec. 19, 2003 (FI) ..... 20031870

(51) Int. Cl.
*H05B 41/16* (2006.01)

(52) U.S. Cl. ..... 315/282; 315/120; 315/278; 315/224; 315/239; 315/246

(58) Field of Classification Search ..... 315/209 R, 315/224, 244, 239, 241 R, 246, 282, 274–279, 315/105, 106, 120, 136
See application file for complete search history.

(56) References Cited

U.S. PATENT DOCUMENTS

| | | | | |
|---|---|---|---|---|
| 3,684,891 | A * | 8/1972 | Sieron | 307/66 |
| 4,104,715 | A * | 8/1978 | Lawson, Jr. | 363/37 |
| 5,367,223 | A | 11/1994 | Eccher | |
| 6,501,225 | B1 | 12/2002 | Konopka | |
| 6,504,318 | B1 | 1/2003 | Pienisaari | |
| 6,636,190 | B1 * | 10/2003 | Hirakata et al. | 345/74.1 |

* cited by examiner

*Primary Examiner*—Haissa Philogene
(74) *Attorney, Agent, or Firm*—Leydig, Voit & Mayer, Ltd

(57) ABSTRACT

An arrangement in connection with a coupling device of a fluorescent lamp, the coupling device comprising a supply transformer, whose secondary is coupled in parallel with a fluorescent tube, the arrangement comprising an indicator circuit configured to indicate the working condition of the fluorescent lamp. The arrangement comprises a signal transformer comprising a first primary coil, to which an alternating voltage signal supply is coupled, a secondary coil, coupled as part of a current path generated by cathodes of the fluorescent lamp and a secondary of the supply transformer and configured to supply alternating current to said current path, the indicator circuit comprising transformer members configured to generate a signal responsive to the alternating current of the current circuit.

6 Claims, 2 Drawing Sheets

ARRANGEMENT IN CONNECTION WITH A COUPLING DEVICE OF A FLUORESCENT LAMP

FIELD OF THE INVENTION

The invention relates to an arrangement in connection with a coupling device of a fluorescent lamp. Particularly, the arrangement of the invention enables the implementation of the condition monitoring of a fluorescent lamp and a lamp circuit in connection with electronic coupling devices.

BACKGROUND OF THE INVENTION

Fluorescent lamps are generally used to achieve the good luminous efficiency produced thereby. In addition, the long operating life of fluorescent lamps and the various colour tones enable the use of the lamps in a plurality of different applications.

Burning fluorescent lamps requires a supply coupling to supply the required ignition voltage to the lamp circuit and the supply voltage required during use. If the supply coupling is formed without active monitoring of the lamp circuit, the problem that arises is that when the fluorescent lamp or the supply circuit gets damaged, it is impossible to automatically switch off the supply transformer, but it continues to supply the lamp circuit with power until manually switched off. When a broken lamp circuit is fixed, i.e. typically replaced with an undamaged fluorescent lamp, the supply transformer has to be switched on again manually.

Finnish publication 107580B discloses a supply coupling of a lamp circuit, wherein the above problem is rectified by adding a separate direct-current supply to the supply coupling, the direct-supply supplying direct current through the cathodes of the fluorescent lamp and the secondary of the supply transformer to a separate indicator circuit, which is arranged to indicate the direct current generated by the direct-current supply and thus the working condition of the fluorescent lamp. The purpose of the indicator circuit is to transfer information about the working condition of the fluorescent lamp to electronics controlling the supply of the fluorescent lamp and to stop the supply of voltage should the lamp or the lamp circuit be damaged.

However, the problem with the solution of the publication is that direct current causes a small direct-current component in the alternating current passing through the fluorescent tube. This direct-current component subjects the electrodes of the fluorescent tube to polarization, i.e. one electrode transforms into a cathode and the other into an anode. This tends to cause uneven wear of the electrodes, whereby active substance is oxidized on the anode and reduced on the cathode. Consequently, the operating life of the electrode acting as the anode shortens.

Furthermore, the prior art separate indicator circuit is located at the potential of the secondary of the supply transformer, whereby the voltage or current message produced by the indicator circuit has to be transferred to the potential of the electronics controlling the coupling device, i.e. the primary of the supply transformer.

BRIEF DESCRIPTION OF THE INVENTION

The object of the present invention is to provide an arrangement in connection with a coupling device of a fluorescent lamp, avoiding the above drawbacks, and enable the generation of a signal indicative of the working condition of a fluorescent lamp without the electrodes polarizing direct to the potential of the electronics controlling the coupling device, which shortens the operating life of the fluorescent tube.

The invention is based on the idea of supplying alternating current through the cathodes of the fluorescent lamp and the secondary of the supply transformer, the alternating current being generated by using a signal transformer to whose primary an alternating voltage is supplied and whose secondary constitutes part of the current part wherein the cathodes of the fluorescent lamp and the secondary of the supply transformer are located. The arrangement of the invention provides a simple and inexpensive solution for transferring information about the working condition of a fluorescent lamp reliably directly to the electronics controlling the coupling device without separate galvanic separations and changes in potential levels. On the basis of this information, the coupling device is able to automatically switch the control of the fluorescent lamp off in connection with malfunction and on when the fluorescent lamp is again in working condition.

BRIEF DESCRIPTION OF THE FIGURES

In the following, the invention will be described in more detail in connection with a preferred embodiment with reference to the accompanying drawings, in which FIG. 1 schematically shows an arrangement in accordance with a preferred embodiment of the invention.

DETAILED DESCRIPTION OF THE INVENTION

The figures show the arrangement according to the invention in connection with a coupling device of a fluorescent lamp. The coupling device comprises a supply transformer T1 whose secondary N12 is coupled in parallel with a fluorescent lamp L. Furthermore, in parallel with the fluorescent lamp L is coupled a capacitor C1, which serves to act as part of the resonance circuit together with the leakage inductance of the supply transformer during the ignition of the fluorescent lamp. Consequently, the supply transformer T1 and the capacitor C1 constitute part of a normal coupling device for operating a fluorescent lamp.

Figure 1:
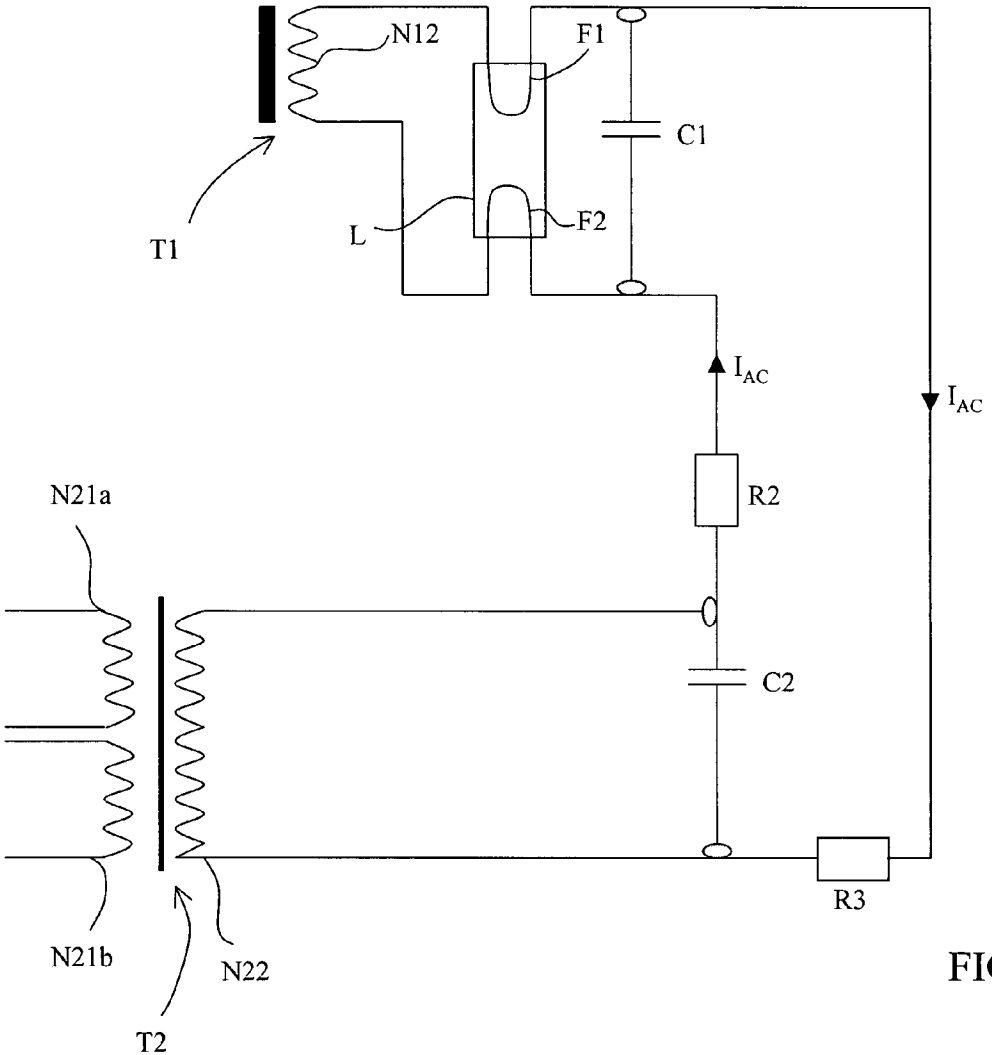

In the arrangement according to a preferred embodiment of the invention shown in FIG. 1, alternating current is supplied through cathodes F1 and F2 and the secondary N12 of the supply transformer T1, and the run of this alternating current is studied. If said current does not run, said current path is shut off for some reason, and the control of the supply transformer can be stopped. To implement this, the arrangement according to a preferred embodiment of the invention comprises a signal transformer T2, which, in accordance with the invention, comprises two primary coils N21*a*, N21*b*, an alternating voltage signal being applied to the first N21*a* of them. In a known manner, the alternating voltage supplied to the primary of the transformer generates a corresponding voltage, modified by a modification ratio, in the secondary. A secondary coil N22 of the signal transformer constitutes part of the current path generated by the fluorescent lamp and the secondary of the supply transformer such that the signal transformer T2 can be used to supply current to said current path.

As mentioned above, the signal transformer T2 comprises a second primary coil T21*b*, which is arranged to generate a voltage proportional to the current of the secondary and thus act as an indicator circuit. By means of a transformer effect, the passage of current through the secondary coil N22 of the signal transformer, the cathodes F1, F2 of the fluorescent lamp and the secondary N12 of the supply transformer achieve a voltage in the second primary coil T21*b*, wherein this voltage is simply detectable.

When said current path is shut off through the cathodes of the fluorescent lamp, the current generated by the signal transformer is unable to run. Since no current runs in the secondary, the voltage of the second primary coil is low. Accordingly, this low voltage or its transforming to low enables reliable detection of the shut-off of the current path, and the supply of voltage to the lamp circuit can be stopped. Thus, the task of the second primary coil is not exact measurement of the current of the secondary coil, but more like the generation of 'low' or 'high' information, allowing the conclusion of the condition of the current path.

The figure further shows protective resistors R2 and R3, and a protective capacitor C2 coupled to the current path. The task of these components is to serve as low-pass filters for the high-frequency voltage generated by the supply transformer for the fluorescent lamp. As the figure shows, the first poles of the protective resistors R2, R3 are coupled directly to the cathodes F1, F2 of the fluorescent lamp, the protective capacitor C2 being coupled between the second poles of the protective resistors R2, R3. Accordingly, these protective components serve to protect the transfer of a high-frequency voltage from the fluorescent lamp towards the signal transformer.

The frequency of the voltage supplied to the signal transformer may be in the order of 10 to 30 kHz and can have almost any waveform, as long as the pulse ratio of the waveform is sufficiently even. Accordingly, voltage information about whether the current path through the secondary N12 of the supply transformer T1 and the cathodes of the fluorescent lamp is obtained from the second primary N21*b* of the signal transformer. The voltage information is obtained as a voltage level, i.e. the voltage of the second primary is high when the current path is shut off and low when the current path is intact. This 'low' and 'high' information can be transferred directly to the base of a semiconductor switch of the control electronics, for example, since the primary coils of the signal transformer may be located directly at the potential of the control electronics. In the solution according to the embodiment of the invention shown in FIG. 1, the signal transformer is used to combine the supply of the alternating current and the separation of the current information.

Figure 2:
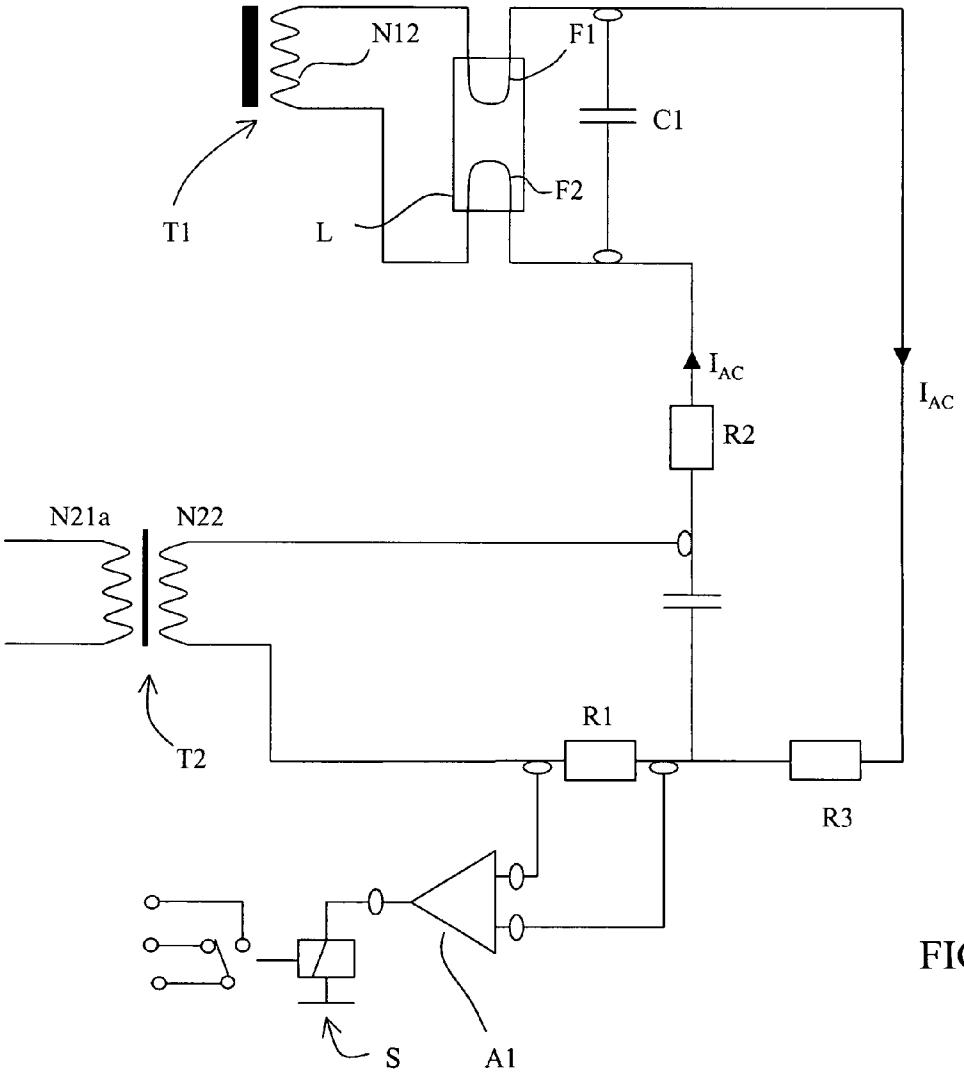
FIG. 2 schematically shows a second preferred embodiment of the invention.

FIG. 2 shows a second preferred embodiment of the invention. In this embodiment, the indicator circuit is implemented with an amplifier coupling, wherein a voltage drop in a resistor R1 placed on the current path is determined with an operation amplifier A1. This operation amplifier A1 further controls the coupling device depending on whether or not current is running on the current path. If no current is running on the current path, the potential difference over the resistor R1 is zero, whereby the output of the operation amplifier is also in the zero position. Whereas, when alternating current is running on the current path, the operation amplifier controls its output into a state deviating from zero. The coupler device at the output of the operation amplifier may be for instance a relay or a semiconductor switch, which may be coupled directly to the potential of the control electronics.

The arrangement of the invention can be used to produce reliable information about the condition of a lamp circuit directly to the potential of the electronics controlling the lamp circuit, allowing the control of the lamp circuit to be stopped in connection with malfunction. For example, when a damaged fluorescent tube is replaced, alternating current starts again to run on the current path, allowing the control electronics controlling the lamp to be automatically switched on.

It is obvious to a person skilled in the art that the basic idea of the invention can be implemented in a variety of ways. Consequently, the invention and its embodiments are not restricted to the above examples, but can vary within the scope of the claims.

The invention claimed is:

1. An arrangement in connection with a coupling device of a fluorescent lamp comprising a fluorescent tube and first and second cathodes, the coupling device comprising a supply transformer comprising a secondary, said secondary being coupled in parallel with said fluorescent tube, the cathodes and the secondary generating a current path, the arrangement comprising an indicator circuit configured to indicate the working condition of the fluorescent lamp, arrangement further comprising a signal transformer comprising a first primary coil, an alternating voltage signal supply being coupled to the first primary coil, a secondary coil, the secondary coil being coupled as part of the current path generated by the cathodes of the fluorescent lamp and a secondary of the supply transformer, said secondary coil being configured to supply alternating current to said current path as a part of a current circuit, the indicator circuit comprising transformer members configured to generate a signal responsive to the alternating current of the current circuit.

2. The arrangement as claimed in claim 1, wherein the signal transformer further comprises a second primary coil configured to serve as an indicator circuit and generate a voltage signal responsive to the alternating current of the current circuit.

3. The arrangement as claimed in claim 1, wherein the indicator circuit comprises a coupling constituted by a resistor and an amplifier, the resistor being coupled to said current circuit and the amplifier being coupled over said resistor to generate a signal responsive to the current of the current circuit.

4. The arrangement as claimed in claim 3, wherein the indicator circuit further comprises a switch component, the amplifier controlling the switch component in response to the alternating current of the current circuit.

5. The arrangement as claimed in claim 1, wherein arrangement further comprises at least first and second protective resistors and a protective capacitor, the protective resistors having poles and being coupled to a current path generated by the secondary of the supply transformer and the cathodes of the fluorescent lamp such that the first protective resistor is directly in series with one cathode of the fluorescent lamp and the second protective resistor is directly in series with the second cathode of the fluorescent lamp, the protective capacitor being coupled between poles of said protective resistors that are not directly coupled to the cathodes of the fluorescent lamp.

6. The arrangement as claimed in claim 2, wherein arrangement further comprises at least first and second protective resistors and a protective capacitor, the protective resistors having poles and being coupled to a current path generated by the secondary of the supply transformer and the cathodes of the fluorescent lamp such that the first protective resistor is directly in series with one cathode of the fluorescent lamp and the second protective resistor is directly in series with the second cathode of the fluorescent lamp, the protective capacitor being coupled between poles of said protective resistors that are not directly coupled to the cathodes of the fluorescent lamp.

* * * * *